United States Patent [19]

Goodrich

[11] 4,062,486

[45] Dec. 13, 1977

[54] CARTON

[75] Inventor: Calvin C. Goodrich, Wyoming, Ohio

[73] Assignee: The Procter & Gamble Company, Cincinnati, Ohio

[21] Appl. No.: 738,926

[22] Filed: Nov. 4, 1976

[51] Int. Cl.[2] ..... B65D 5/54

[52] U.S. Cl. ..... 206/626; 229/17 R

[58] Field of Search ..... 229/51 TC, 51 SC, 51 D, 229/17 R

[56] References Cited

U.S. PATENT DOCUMENTS

| | | | |
|---|---|---|---|
| 2,260,137 | 10/1941 | Donnelly | 229/51 TC |
| 2,336,706 | 12/1943 | Sunderhauf | 229/17 R |
| 2,753,104 | 7/1956 | Wagner, Jr. | 229/51 TC |
| 2,789,746 | 4/1957 | Houland | 229/51 TC X |
| 2,819,831 | 1/1958 | Polarek et al. | 229/17 R |
| 3,167,238 | 1/1965 | Smith | 229/51 TC |
| 3,180,553 | 4/1965 | Schreiber et al. | 229/17 R |
| 3,861,583 | 1/1975 | Tingley et al. | 229/51 TC |

FOREIGN PATENT DOCUMENTS

| | | | |
|---|---|---|---|
| 402,912 | 12/1933 | United Kingdom | 229/51 TC |
| 603,543 | 6/1948 | United Kingdom | 229/51 TC |

*Primary Examiner*—Davis T. Moorhead

*Attorney, Agent, or Firm*—John V. Gorman; Richard C. Witte; Thomas H. O'Flaherty

[57] ABSTRACT

A seal-end carton in which the adhered plies comprising the top closure and a contiguous removable section of the front panel are formed into a reclosable hinged lid when an extension of the outer major flap is lifted. The removable section is glued to the extension and is integral with the inner major flap. Dust flaps are located intermediate the inner and outer major flaps and have lines of weakness thereacross which align with the end edges of the inner major flap.

3 Claims, 4 Drawing Figures

CARTON

BACKGROUND OF THE INVENTION

1. Field of the Invention

This invention relates to seal-end cartons and, more particularly, to a seal-end carton which has a closure opening device thereon.

2. Description of the Prior Art

It is well known in the carton art to employ a flap which is adhesively secured to a removable section in an underlying carton wall to tear the removable section away when the flap is lifted. It is also old in the carton art to perforate portions of flaps articulated to panels adjacent the carton wall in which the removable section is located, thereby permitting simultaneous lifting of a united lid structure. Both of these features are shown in Shreiber et al., U.S. Pat. No. 3,180,553, issued Apr. 27, 1965. Other prior art patents concerning cartons having relatively similar features are Ball, U.S. Pat. No. 2,470,388, issued May 27, 1949, Sunderhauf, U.S. Pat. No. 2,336,706, issued Dec. 14, 1943, Polarek et al., U.S. Pat. No. 2,819,831, issued Jan. 14, 1958, Rossi, U.S. Pat. No. 3,133,689, issued May 19, 1964, and Hickin, U.S. Pat. No. 3,104,793, issued Sept. 24, 1963. While each of these patented cartons admittedly has its good features, they are to varying degrees accompanied by shortcomings such as difficulty in opening, restricted size of opening, potential defacement of the carton by the opening action, substantial weakening of the carton due to use of perforations, dust infiltration potential and the lack of physical display of contents.

SUMMARY OF THE INVENTION

In accordance with the present invention there is provided a seal-end carton provided with an easily opened end closure. The closure comprises an inner major flap hinged to the front panel of the carton, an outer major flap articulated to the back panel and dust flaps hinged to the side panels and located between the inner and outer major flaps. The front panel has a line of weakness therein which defines a removable portion along the line of articulation of the inner major flap. The line of weakness extends to opposite ends of the line of articulation. Each of the dust flaps has a line of weakness commencing at a point adjacent an end of the line of articulation and extending across its width. The end edges of the inner major flap is configured to generally align with the lines of weakness in the dust flaps. An extension is attached to the distal end of the outer major flap and is adapted and sized to overlie the line of weakness defining the removable portion of the front panel. The extension is adhesively attached to the removable portion and the dust flaps are adhesively attached to the inner and outer major flaps.

DESCRIPTION OF PREFERRED EMBODIMENT

Figure 1:
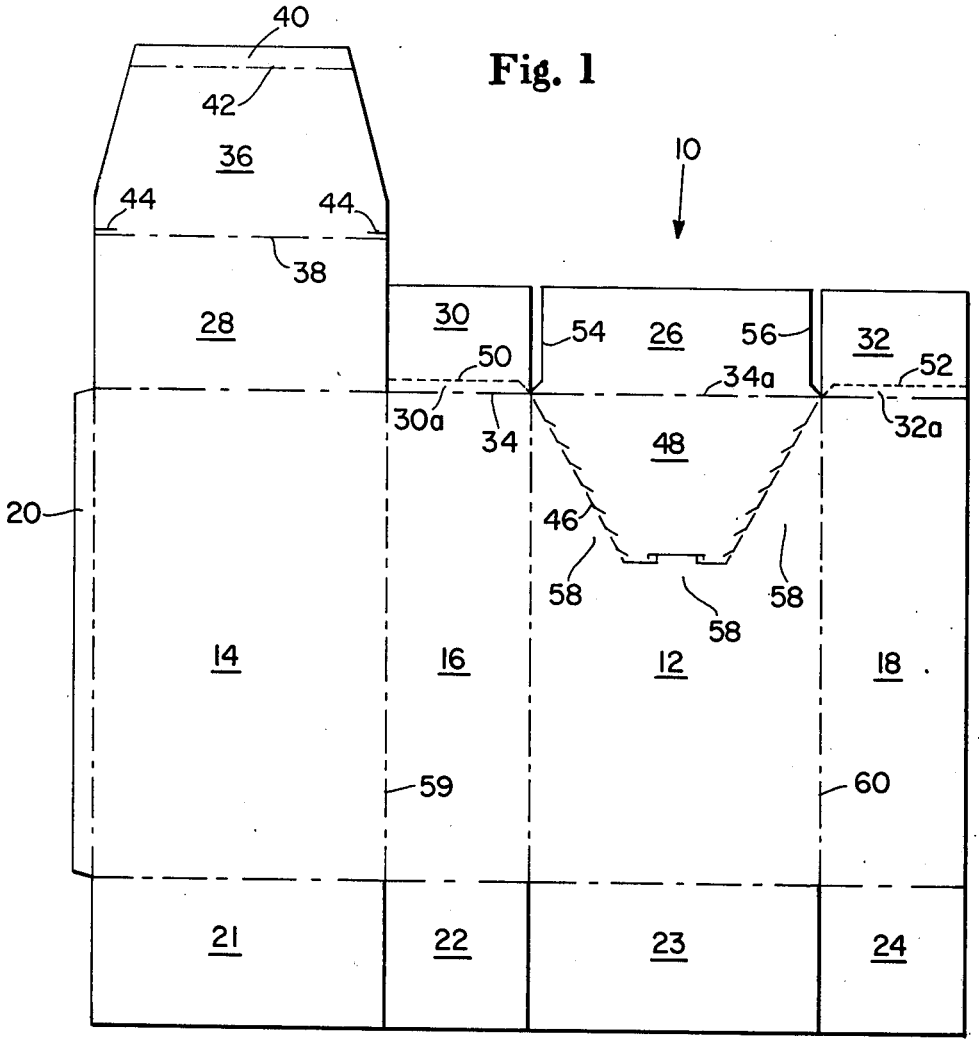
FIG. 1 is a plan view of the outer surface of a blank for a carton of the subject invention.

Referring to FIG. 1, there is shown a carton blank 10 of the present invention. The carton blank 10 comprises front panel 12, back panel 14, side panels 16, 18 and glue flap 20. Flaps 21, 22, 23 and 24 are articulated to the bottoms of the carton panels and are sized to provide a conventional seal end bottom closure. At the top of the carton inner major flap 26, outer major flap 28 and dust flaps 30, 32 are articulated, respectively, to front panel 12, back panel 14 and side panels 16, 18 along score line 34.

Outer major flap 28 has an extension 36 articulated from its distal end along score line 38. The extension 36 is provided with a lift tab portion 40 defined by score line 42. Short transverse knife cuts 44, designed to effect reclose latching following opening of the carton, are also provided.

The front panel 12 has a line of weakness 46 therein defining a removable portion 48 contiguous to line of articulation **34*a*, which comprises the section of score line 34 along which the inner major flap 26 is attached. The line of weakness 46 extends to the opposite ends of line of articulation 34*a* and can comprise any conventional perforation pattern but, as shown, is preferably one which minimizes the possibility of ply separation and tearing outside the confines of the removable portion 48. The removable portion 48 and the extension 36 are sized relatively so that the extension 36 overlies the line of weakness 46** in the sealed carton, as will be more fully understood from subsequent description.

The dust flaps 30, 32 have lines of weakness 50, 52 extending thereacross, each commencing adjacent an end of line of articulation **34*a*. Preferably, each line of weakness 50, 52 is at an angle with score line 34 at its commencing end, extending obliquely (either along a curved path or, as shown, along a straight line) a short distance, preferably at least about ¼ inch or so, and then proceeding across the respective dust flaps 30, 32 in a direction generally parallel with score line 34. This facilitates tear initiation in the dust flaps and minimizes the possibility of ragged tearing, while maintaining strength of the corners of the closure and sealing against the entry of dust through the perforations comprising lines of weakness 50, 52**.

The inner major flap 26 is trimmed or cut out adjacent the dust flaps 30, 32 to provide end edges 54, 56. Each of the pieces cut-out is similar in shape to the adjacent dust flap portions **30*a* or 32*a*, so that when the carton is completed, squared and sealed the edges 54, 56 are generally aligned with lines of weakness 50, 52. Completion of the carton can be accomplished by applying glue to the outer surface of glue flap 20, folding glue flap 20 and back panel 14 rearwardly 180° along score line 59 and folding side panel 18 rearwrdly 180° along score line 60, so that the adhesive on glue flap 20 joins the same to the inner surface of side panel 18**.

Figure 2:
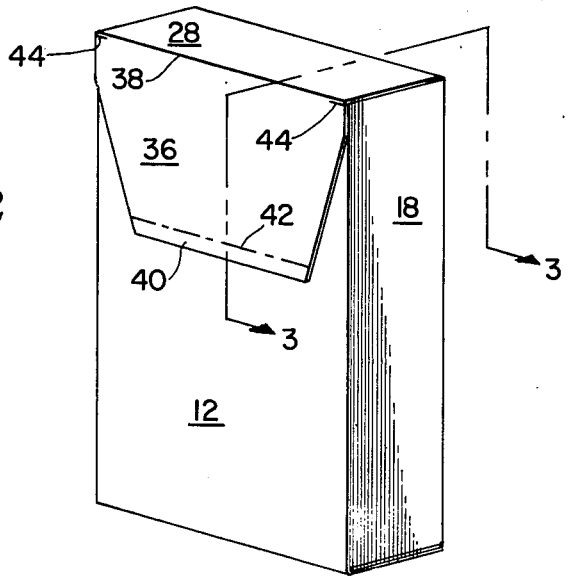
FIG. 2 is a perspective view of the carton of FIG. 1, following sealing of the end closures thereof.
Figure 3:
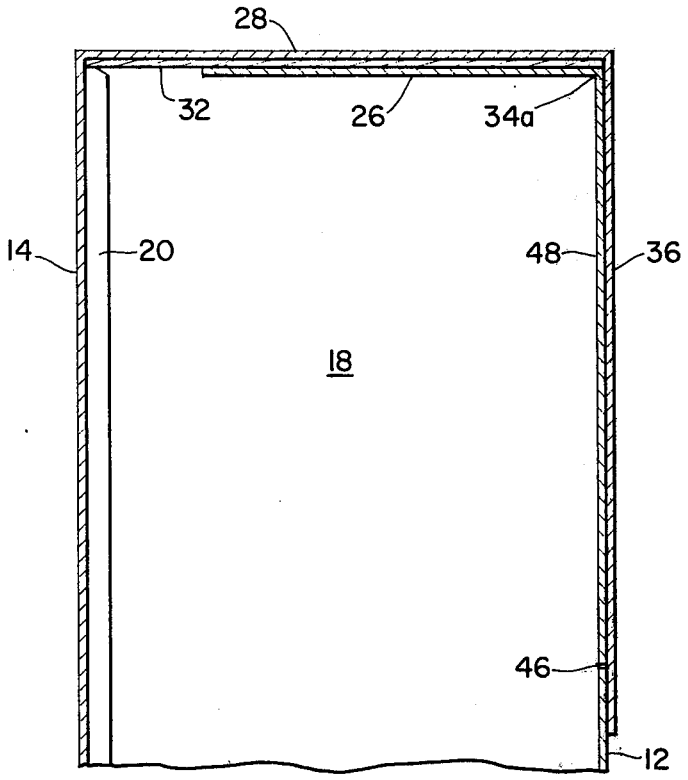
FIG. 3 is an enlarged cross sectional view, partially broken away, taken along the lines 3—3 of FIG. 2.
Figure 4:
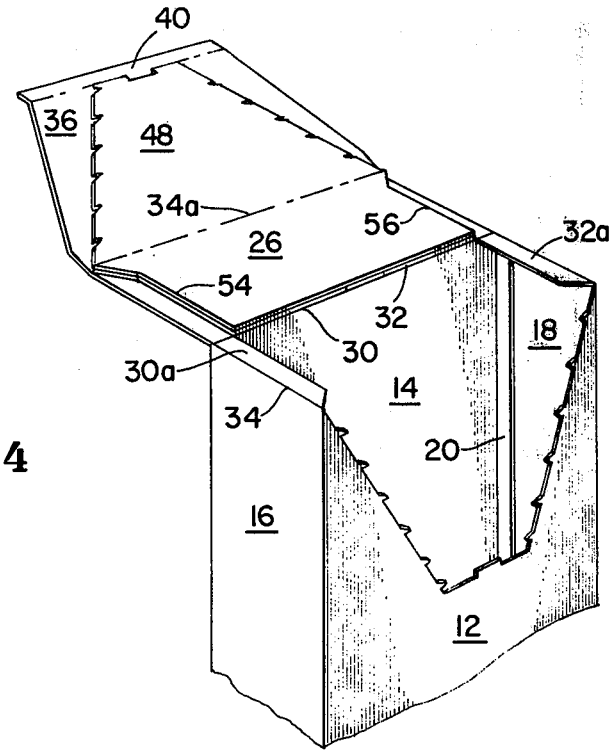
FIG. 4 is a perspective view, partially broken away of the carton of FIGS. 1-3, following opening of the top closure.

The carton may be squared, filled and processed on normal production line equipment in a manner well known to those of oridnary skill in the art. The bottom closure flaps are closed and sealed and the carton filled, as desired. The top closure is formed as shown in FIGS. 2 and 3 by folding the inner major flap 26 inwardly 90° along line of articulation **34*a*. Then the dust flaps 30, 32 are folded 90° inwardly in overlying relation to major flap 26. Finally, outer major flap 28 and extension 36 are folded inwardly 90° (along the portion of scoreline 34 forming the top edge of back panel 14) and the extension 26 is subsequently folded 90° downwardly along score line 38, to cover removable portion 48**.

At some appropriate point in the top closure forming operation, glue is applied to the various flaps to effect the seal. This could be done, for example, by applying adhesive to the inside surface of the dust flaps 30, 32 and the inside surface of the outer major flap 28 and extension 36. In this manner the dust flaps 30, 32 can be adhered to the inner major flap 26, the outer major flap 28 attached to the dust flaps 30, 32 and the extension 36 joined to removable portion 48. Preferably, the areas 58, FIG. 1, of front panel 12 exterior of line of weakness 46 are not adhered to extension 36. This can be accomplished by precisely applying the glue using a patterned glue roll or by coating such areas 58 of the front panel 12 with varnish to prevent firm adhesion.

In use, the carton is opened by the consumer grasping lift tab portion 40 of extension 36, then lifting it outwardly and upwardly. Such action separates removable portion 48 from front panel 12 along line of weakness 46 and pulls the integrally attached inner major flap 26 upwardly, thereby tearing the distal ends of dust flaps 30, 32 loose along lines of weakness 50, 52. The result, as illustrated in FIG. 3, provides easy access to the contents of the carton and provides an attractive means to physically display such contents. Since all perforations are covered by flaps when the carton is sealed, this prevents the easy entrance of dust and dirt, thus eliminating the need for auxiliary product protection of the contents. Moreover, reclosure may thereafter be effected by inserting the extension 36 and attached removable section 48 in the carton interior parallel to the front panel 12 and and between it and dust flap portions 30*a* and 32*a*. In this condition, transverse knife cuts 44 provides a relatching function.

Many modifications of the above invention may be used and it is not intended to limit it to the particular embodiment shown and described. The terms used in describing the invention are used in their descriptive sense and not as terms of limitation, it being intended that all equivalents thereof be included in the scope of the appended claims.

What is claimed is:

1. A seal-end carton of rectangular cross-section comprising alternating side, front and back panels and provided with an easily opened end closure, said closure comprising an inner major flap articulated to the front panel, an outer major flap articulated to the back panel and dust flaps articulated to the side panels, the dust flaps being located intermediate the inner and outer major flaps, the front panel having a line of weakness therein defining a removable portion contiguous the line of articulation along which said inner major flap is attached, said line of weakness extending to opposite ends of said line of articulation, the dust flaps each having a line of weakness extending thereacross from one side to the other with the major portion thereof generally parallel to and spaced from the line of articulation of the dust flap, said line of weakness on each dust flap commencing at the adjacent end of said inner major flap line of articulation and extending obliquely, distally, therefrom, the end edges of said inner major flap being generally aligned with the lines of weakness in the dust flaps, an extension attached to the distal end of the outer major flap, said extension being adapted and sized to overlie the line of weakness defining said removable portion of said front panel, said extension being adhesively attached to said removable portion, the ends of said dust flaps distal of the lines of weakness being adhesively attached to the inner and outer major flaps.

2. The carton of claim 1 in which the ends of said inner major flap are trimmed by cutting out portions shaped to match the portion of the adjacent dust flap which is intermediate its line of weakness and line of articulation.

3. The carton of claim 2 in which the major portions of said lines of weakness across the dust flaps are spaced at least about 174 inch from the lines of articulation of the dust flaps.

* * * * *

UNITED STATES PATENT OFFICE

CERTIFICATE OF CORRECTION

PATENT NO. : 4,062,486

DATED : December 13, 1977

INVENTOR(S) : Calvin C. Goodrich

It is certified that error appears in the above-identified patent and that said Letters Patent are hereby corrected as shown below:

Column 1, line 21 "May 27, 1949" should read -- May 17, 1949.

Claim 3, line 3, "174" should read -- 1/4 --.

Signed and Sealed this

Fourth Day of April 1978

[SEAL]

*Attest:*

RUTH C. MASON
*Attesting Officer*

LUTRELLE F. PARKER
*Acting Commissioner of Patents and Trademarks*